US007682069B2

(12) United States Patent
Hyatt

(10) Patent No.: US 7,682,069 B2
(45) Date of Patent: Mar. 23, 2010

(54) TRACKING AND MONITORING SYSTEM

(76) Inventor: Dequincy A. Hyatt, 56623 Edgewood, Shelby Township, MI (US) 48316

( * ) Notice: Subject to any disclaimer, the term of this patent is extended or adjusted under 35 U.S.C. 154(b) by 0 days.

(21) Appl. No.: 11/739,898

(22) Filed: Apr. 25, 2007

(65) Prior Publication Data

US 2008/0267014 A1 Oct. 30, 2008

(51) Int. Cl.
*G04B 37/00* (2006.01)
*A44C 5/00* (2006.01)
*E05B 63/14* (2006.01)

(52) U.S. Cl. ..... 368/282; 368/10; 224/164; 24/265 WS

(58) Field of Classification Search ..... 368/11, 368/282; 340/539.13; 70/16, 121, 123, 137, 70/139; 224/164; 24/265 WS
See application file for complete search history.

(56) References Cited

U.S. PATENT DOCUMENTS 3,913,182 A * 10/1975 Fontana ..... 24/71 J
5,627,520 A * 5/1997 Grubbs et al. ..... 340/572.1
5,652,570 A * 7/1997 Lepkofker ..... 340/573.4
6,031,460 A * 2/2000 Banks ..... 340/573.1
6,263,280 B1 * 7/2001 Stingone, Jr. ..... 701/213
2001/0055243 A1 * 12/2001 Haywood ..... 368/10
2003/0151506 A1 * 8/2003 Luccketti ..... 340/539.13
2003/0218539 A1 * 11/2003 Hight ..... 340/539.13
2004/0032333 A1 * 2/2004 Hatt ..... 340/574
2005/0249049 A1 * 11/2005 Jarrett et al. ..... 368/250
2007/0103293 A1 * 5/2007 Martin et al. ..... 340/539.13

* cited by examiner

*Primary Examiner*—Vit W Miska
*Assistant Examiner*—Sean Kayes
(74) *Attorney, Agent, or Firm*—Carlson, Gaskey & Olds, P.C.

(57) ABSTRACT

A tracking device is incorporated into a watch. The tracking device appears as an ordinary watch, but cannot be removed by the individual wearing it. If necessary, the location of the tracking device can be determined by a central server and reported to the authorities or to the individual's family.

15 Claims, 3 Drawing Sheets

TRACKING AND MONITORING SYSTEM

BACKGROUND

The present invention relates generally to tracking devices and more particularly to a tracking device which is not removable by the user.

Systems for tracking and monitoring individuals have been developed for several different applications. First, convicted criminals may be sentenced to stay at home for a period of time. If the individual leaves their home without authorization, the authorities activate the tracking device to locate the individual and arrest him. In another application, an individual who has been released on bail may be required to wear a tracking device to ensure his appearance in court for the hearing and for the trial. In these applications, a large, conspicuous electronic device is locked to the individual's ankle and cannot be removed by the individual. Upon activation by the authorities, the location of the individual can be tracked using GPS, cell towers, etc.

Individual tracking devices are also used for Alzheimer's patients. These patients may become confused or disoriented and simply "wander off." Because these individuals are not consciously trying to avoid being located, their tracking devices need not be locked to the individual. It is not expected that these individuals would make any attempt to remove the tracking device, or that they would even be aware of the tracking device.

However, there is yet another class of individuals for whom tracking and monitoring would be beneficial, who might at times attempt to remove the tracking device, but do not deserve to be treated as criminals. Some mentally ill patients, even mentally ill patients who can function very well when diligently taking their prescribed medications, may occasionally have relapses if they stop taking their medication. During these times, the person may become confused or delusional and may either wander aimlessly or travel quite deliberately long distances while suffering from their delusions. During this time, family members may be unable to locate the individual and get them the help and medication that they need. During these episodes, these individuals may try to remove the tracking devices. However, the conspicuous ankle bracelets used on criminals are inappropriate for these individuals, especially because they are able to function quite normally when taking medication.

SUMMARY

The present invention provides a tracking device that cannot be removed by the user, but does not appear unusual to other observers. In the embodiments disclosed herein, the tracking device is configured in the form of a watch, or as part of a watch. The watch band is lockable such that it cannot be removed by the wearer, but there is no outward indication that the watch includes a tracking device or is anything other than an ordinary watch.

Like the known tracking devices, the tracking device includes a GPS receiver or other location determining device. The tracking device further includes some means of communicating its location to a central monitoring system. When activated through the central monitoring system, the tracking device transmits its location, as determined by the GPS receiver, to the central monitoring system.

These and other features of the application can be best understood from the following specification and drawings, the following of which is a brief description.

DETAILED DESCRIPTION OF THE PREFERRED EMBODIMENT

Figure 1A:
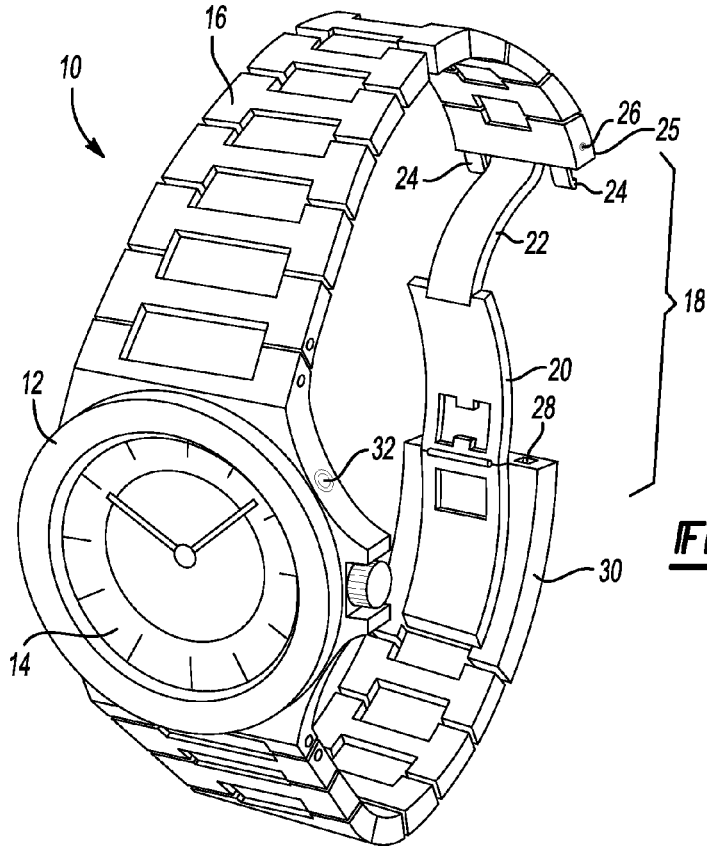
FIG. 1A is a perspective view of a tracking device according a first embodiment of the present invention.

FIG. 1A is a perspective view of a tracking device 10 according to a first embodiment of the present invention. The tracking device 10 includes a watch body 12 having a watch display, such as watch face 14 (watch display could also be a digital display). A watchband 16 is connected to the watch body 12 and is selectively closable by a fastening system 18. The fastening system 18 includes a first curved bar 20 and second curved bar 22 pivotably connected and connecting a first connecting link 25 and a second connecting link 30. A first connecting link 25 includes a pair of hooks 24 extending therefrom. The hooks 24 are selectively lockable by keyway 26. The hooks 24 are also receivable within apertures 28 on the second connecting link 30.

The watch body 12 is fully functional as a watch, including watch hands on a watch face 14. Alternatively, digital watches could also be provided in any of the embodiments shown in this application. The watch body 12 further includes an optional "panic" or "help" button 32 that is recessed into the body 12.

Figure 1B:
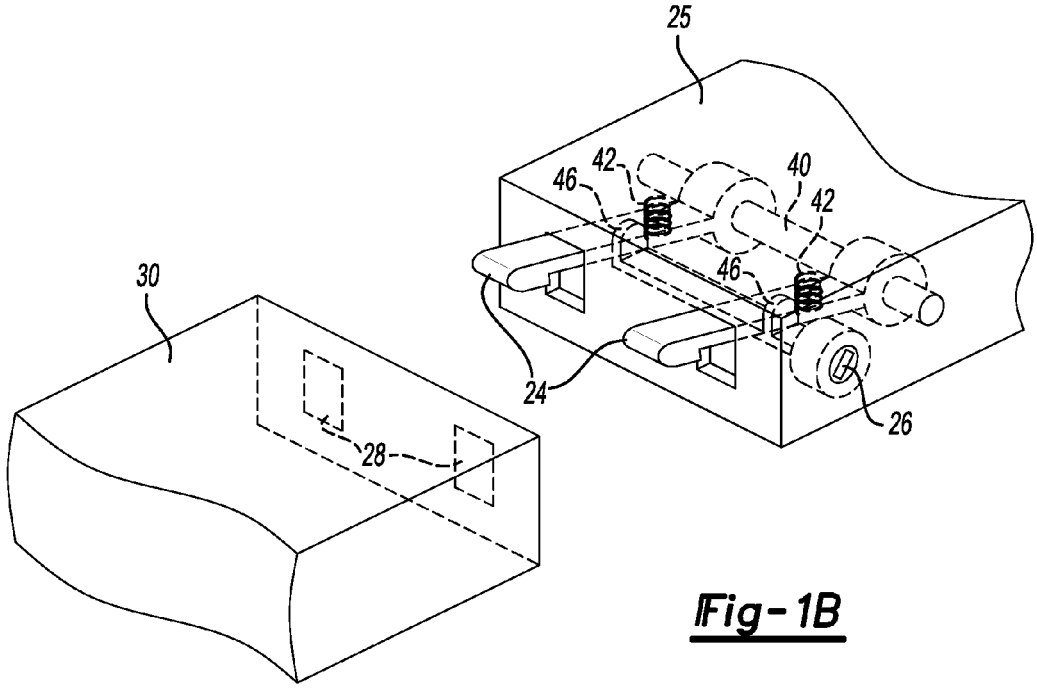
FIG. 1B is an enlarged view of the two ends of the watchband of FIG. 1A.

Referring to FIG. 1B, inside the first connecting link 25, the hooks 24 are pivotable on (or pivotable with) a shaft 40 and are biased toward a locked position by springs 42. The hooks 24 are biased downwardly by the springs 42 and can be selectively released by cams 46 rotatable by the keyway 26. The second connector link 30 includes apertures 28 into which the hooks 24 can be received and to which the hooks 24 are latched. When the hooks 24 are inserted into the apertures 28 and the keyway 26 is rotated to the lock position, the springs 42 bias the hooks 24 downwardly, thereby locking the hooks 24 in the apertures 28 and locking the first connector link 25 to the second connector link 30. In this position, the tracking device 10 cannot be removed from the user's wrist. The keyway 26 can be rotated such that the cams 46 push the hooks 24 upwardly, thereby releasing the hooks 24 from the apertures 28 so that they can be removed from the apertures 28 and the first connecting link 25 can be separated from the second connecting link 30 and the tracking device 10 can be removed.

Figure 2A:
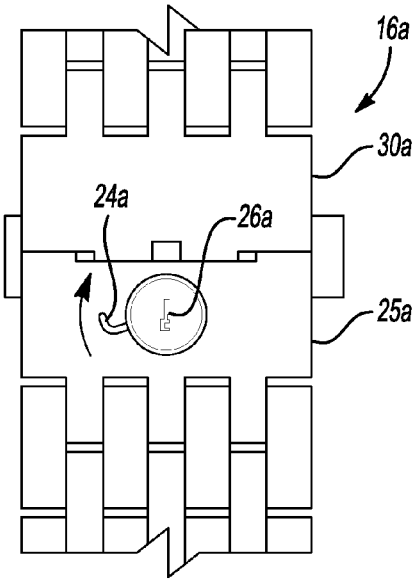
FIG. 2A is an enlarged view of two ends of an alternate watchband.
Figure 2B:
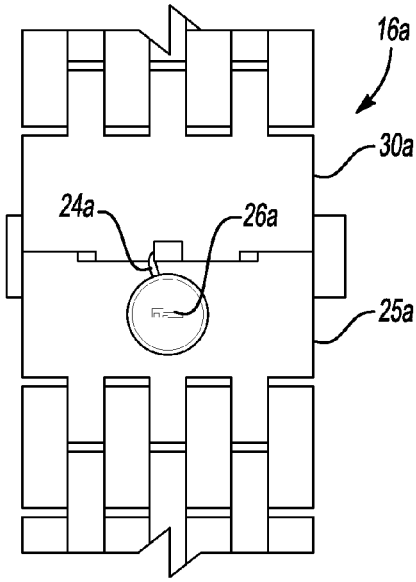
FIG. 2B illustrates the watchband of FIG. 2A in a locked position.

FIGS. 2A and 2B show an alternate connection mechanism. A first connector link 25*a* is connected to a second connector link 30*a* by a rotating keyway 26*a*. A hook 24*a* rotates inside the first connector link 25*a* upward rotation of the keyway 26*a*. The hooks 24*a* is received within an aperture (not visible) in the second connector link 30*a*, thereby rendering the watchband 16*a* irremovable from the user. The watchband 16*a* can then be removed by unlocking the second connector link 30*a* from the first connector link 25*a* by rotation of the keyway 26*a*.

Figure 3:
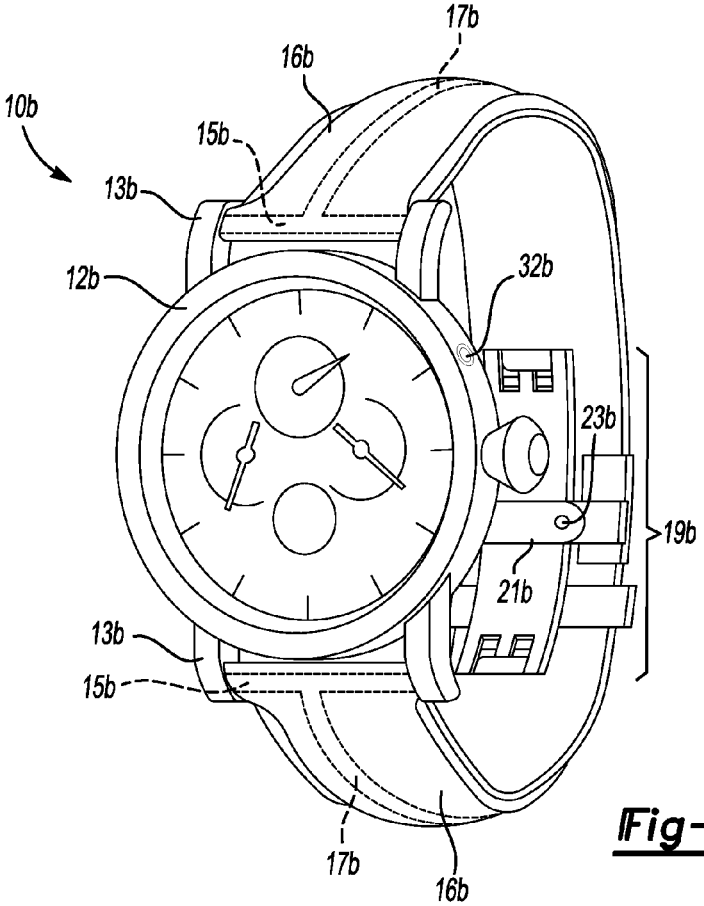
FIG. 3 illustrates an alternate tracking device.

FIG. 3 illustrates a third embodiment of a tracking device 10*b*. A watch body 12*b* includes two pair of spaced apart prongs 13*b* connected by a crossbar 15*b*. A flexible braided cable 17*b* is connected to each crossbar 15*b*. The cable 17*b* and crossbar 15*b* are hidden inside another (or other material) watchband 16*b*. The connection between the two watchband halves may be as indicated in FIG. 1A and FIG. 1B. An adjustment mechanism 19*b* is also provided. The adjustment mechanism 19*b* is similar to known watchband mechanisms in which a lever clamps down onto the watchband halves. However, in the tracking device 10*b*, the lever 21*b* is retained by a fastener, such as an Allen screw 23*b*. Thus, adjustment of the watchband 16*b* can be provided, but the watchband 16*b* cannot be adjusted while the user is wearing the tracking device 10*b*. Again the tracking device 10*b* is connected and disconnected similar to the connection system 18 of FIGS. 1A and 1B.

Figure 4:
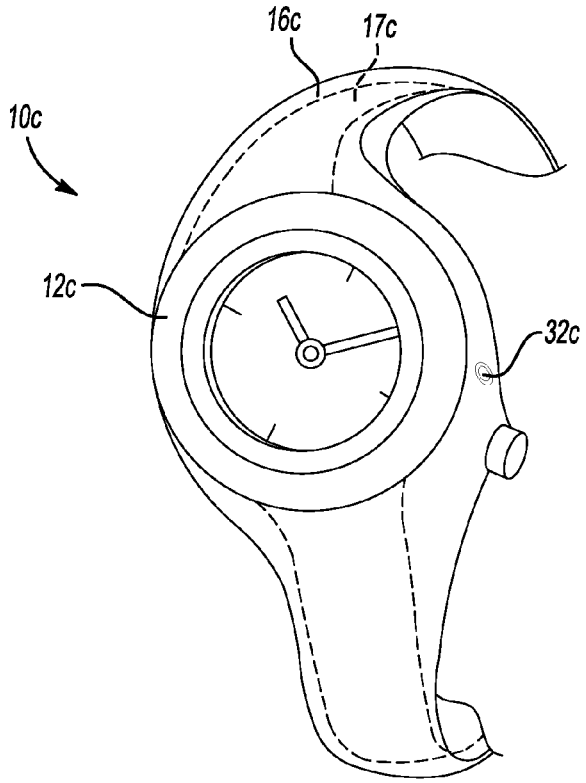
FIG. 4 illustrates a third alternate tracking device.

FIG. 4 illustrates another embodiment of the tracking device 10*c*. In this embodiment, a flexible metal band or braided cable 17*c* is connected directly to the watch body 12*c*, such as by welding, soldering, or other permanent connection. The cable 17*c* is hidden within the leather (or other material) band 16*c* such that the tracking device 10*c* appears to be an ordinary watch. The watchband 16*c* is connected and disconnected according to any of the connection systems of FIGS. 1-3.

Figure 5:
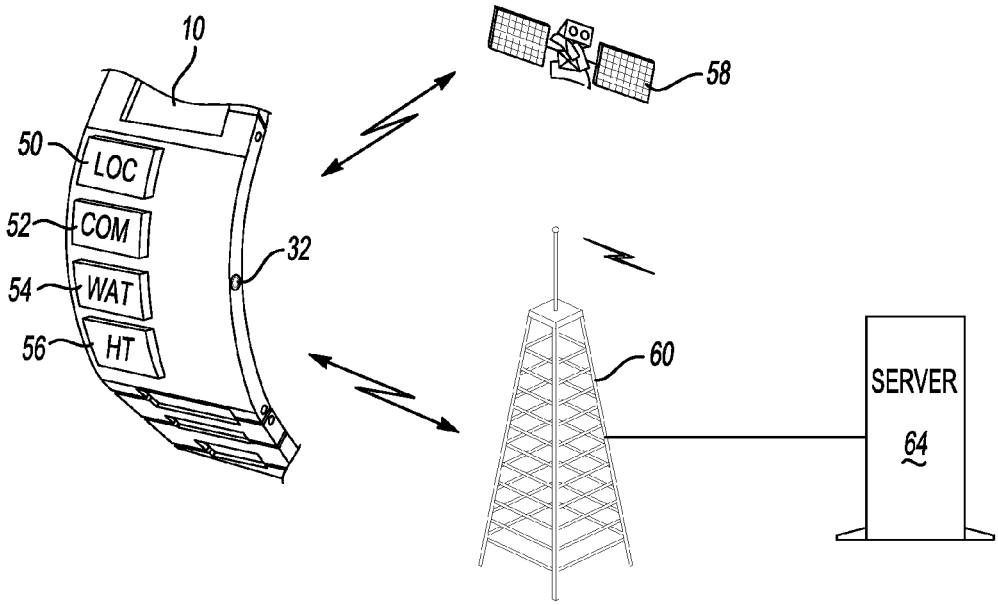
FIG. 5 is a schematic of a tracking and monitoring system including one of the tracking devices of FIGS. 1-4.

FIG. 5 is a schematic illustrating a tracking and monitoring system in which the tracking device 10 can be used. The tracking device 10 can be any of the tracking devices 10, 10*a*, 10*b*, 10*c* of FIGS. 1-4 or any suitable variation. The tracking device 10 includes a GPS receiver 50 or other location determining circuitry (such as circuitry whose location is determined by cell towers). The tracking device 10 further includes communication circuitry 52, such as cell phone or other wireless data transmission circuitry. The tracking device 10 further includes a watch function 54, such that the tracking device 10 operates and appears as a normal watch. The tracking device 10 may optionally include a health monitoring circuit 56, such as for monitoring heart rate, blood pressure, temperature, blood sugar. This health related information can be used to either trigger a communication or can be periodically transmitted from the tracking device via communication circuitry 52, or can be retrieved via the communication circuitry 52.

The tracking device 10 further includes a panic or help button 32, with which the user can request assistance by initiating communication via the communication circuitry 52, which automatically transmits the location of the tracking device 10 as determined by the GPS 50, and optionally health related information to a cell tower 60 or other external communication circuitry (including wi-fi, or other data communication protocols). The cell tower 60 is in communication with a central server 64. The central server 64 is equipped to monitor thousands of such tracking devices over a large area. The identification of the individual wearing the tracking device is stored in the server 63 and associated with that particular tracking device. Health information, contact information, historical information are all stored on server 64 and associated with that individual's tracking device 10. Satellites 58 also communicate with tracking device 10, including the GPS received 50 and optionally the communication circuitry 52.

In use, if an individual is reported missing by their family, the server 64 can track the location of the individual's tracking device 10 and report that location to the family or to the authorities. The operators monitoring the server 64 can also track the health status of the individual wearing the tracking device 10 and report this to the family members or other authorities.

In some situations, if the individual wearing the tracking device 10 becomes lost or otherwise is in need of assistance, they either can press the help or panic button 32 which will initiate a call for help to the central server 64.

Although an example embodiment has been disclosed, a worker of ordinary skill in this art would recognize that certain modifications would come within the scope of the claims. For that reason, the following claims should be studied to determine their true scope and content.

What is claimed is:

1. A tracking device comprising:

a time-keeping device;

a watch display indicating time as indicated by the time-keeping device;

a location determining device for providing a location of the tracking device;

a watchband, the watchband including a rigid curved first bar and a rigid curved second bar pivotably connected to the first bar, the first bar and the second bar pivotable relative to one another between an open position and a closed position; and a lock selectively locking the watchband to a user by locking the first bar and the second bar in the closed position, the lock including a key way selectively unlocking the lock and at least one hook moved into and out of a locked position by rotation of a key in the key way.

2. The tracking device of claim 1 further including a communication circuit for reporting the location to a central server.

3. The tracking device of claim 1 wherein the key way selectively locks the lock.

4. The tracking device of claim 1 wherein the location determining device includes a GPS receiver.

5. The tracking device of claim 1 wherein the watch display includes a watch face and hands.

6. The tracking device of claim 1 further including a health monitoring circuit.

7. The tracking device of claim 6 further including a communication circuit for reporting a health condition as determined by the health monitoring circuit to a central server.

8. The tracking device of claim 1 wherein the watchband includes a first half and a second half, both secured to a watch body, the watch body housing the time keeping device and the location determining device.

9. The tracking device of claim 8 wherein the lock selectively connects the first half of the watchband to the second half.

10. A tracking device comprising:

a time-keeping device in a watch body, the watch body including two pair of spaced apart prongs, each pair of spaced apart prongs connected by a crossbar;

a watch display indicating time as indicated by the time-keeping device, the watch display on the watch body;

a location determining device for providing a location of the tracking device, the location determining device in the watch body;

a watchband including a flexible metal cable hidden within an outer flexible material, the flexible metal cable connected directly to one of the crossbars of the watch body at a first end and to the other of the crossbars at a second end opposite the first end; and a lock connected directly to the flexible metal cable selectively locking the watchband to a user, the lock unlockable only by a key.

11. The tracking device of claim 10 wherein the outer flexible material is leather.

12. The tracking device of claim 10 further including an adjustment mechanism for adjusting a length of the watchband.

13. The tracking device of claim 10 further including an adjustment mechanism for adjusting a length of the watchband, the adjustment mechanism including a clamp for clamping down on halves of the watchband.

14. The tracking device of claim 13 wherein the clamp is held closed by a fastener than cannot be removed when the watchband is worn by a user.

15. The tracking device of claim 14 wherein the flexible metal cable is a braided cable and wherein the outer flexible material is leather.

* * * * *